US011060701B2

(12) United States Patent
Van Delden

(10) Patent No.: US 11,060,701 B2
(45) Date of Patent: Jul. 13, 2021

(54) ACOUSTICALLY ABSORBENT LIGHTING MODULE

(71) Applicant: SIGNIFY HOLDING B.V., Eindhoven (NL)

(72) Inventor: Martinus Hermanus Wilhelmus Maria Van Delden, Eindhoven (NL)

(73) Assignee: Signify Holding B.V., Eindhoven (NL)

( * ) Notice: Subject to any disclaimer, the term of this patent is extended or adjusted under 35 U.S.C. 154(b) by 0 days.

(21) Appl. No.: 17/043,171

(22) PCT Filed: Apr. 1, 2019

(86) PCT No.: PCT/EP2019/058154
§ 371 (c)(1),
(2) Date: Sep. 29, 2020

(87) PCT Pub. No.: WO2019/192950
PCT Pub. Date: Oct. 10, 2019

(65) Prior Publication Data

US 2021/0025567 A1 Jan. 28, 2021

(30) Foreign Application Priority Data

Apr. 6, 2018 (EP) ..... 18166000

(51) Int. Cl.
*F21V 15/01* (2006.01)
*E04B 9/00* (2006.01)
(Continued)

(52) U.S. Cl.
CPC ..... *F21V 15/01* (2013.01); *E04B 9/001* (2013.01); *F21S 8/026* (2013.01); *G10K 11/162* (2013.01); *F21Y 2115/10* (2016.08)

(58) Field of Classification Search
CPC . F21V 15/01; F21V 1/00; E04B 9/001; E04B 9/32; F21S 8/026; F21S 8/03; F21Y 2115/10; F21Y 2105/10; G10K 11/162
See application file for complete search history.

(56) References Cited

U.S. PATENT DOCUMENTS 7,303,305 B2 12/2007 Kennedy
9,506,643 B1 11/2016 Rapisarda
(Continued)

FOREIGN PATENT DOCUMENTS

DE 102012013266 A1 1/2014
EP 2653775 A1 10/2013
(Continued)

OTHER PUBLICATIONS

Leth & Gori, "Textilisations—Pleated Sound, Woven Light", Jul. 29, 2014, pp. 1-10.

*Primary Examiner* — Kevin Quarterman
(74) *Attorney, Agent, or Firm* — Daniel J. Piotrowski

(57) ABSTRACT

A lighting module (10) is disclosed comprising a housing (15) and a woven fabric (50) defining a light exit window across said housing, the housing comprising an acoustically absorbent panel (20) opposing the woven fabric and a light engine arrangement (30) on the acoustically absorbent panel arranged to generate a light output through the light exit window, the lighting module further comprising a felt-based volumetric diffuser (40) in between the woven fabric and the light engine arrangement. Also disclosed are a N lighting kit and luminaire comprising such lighting modules (10).

10 Claims, 9 Drawing Sheets

(51) Int. Cl.

| | |
|---|---|
| ***F21S 8/02*** | (2006.01) |
| ***G10K 11/162*** | (2006.01) |
| *F21Y 115/10* | (2016.01) |

(56) References Cited

U.S. PATENT DOCUMENTS

| | | | | |
|---|---|---|---|---|
| 9,666,107 | B2 | 5/2017 | Van Pieterson et al. | |
| 2004/0070967 | A1* | 4/2004 | Kennedy | H04R 1/028 362/147 |
| 2012/0327651 | A1* | 12/2012 | Cornelssen | F21V 1/14 362/231 |
| 2016/0186942 | A1* | 6/2016 | De Gier | F21S 8/026 362/234 |
| 2017/0159928 | A1* | 6/2017 | Gommans | E04B 9/34 |

FOREIGN PATENT DOCUMENTS

| | | | |
|---|---|---|---|
| FI | 11839 | U1 | 10/2017 |
| WO | 2013038292 | A1 | 3/2013 |
| WO | 2015071130 | A1 | 5/2015 |

* cited by examiner

ACOUSTICALLY ABSORBENT LIGHTING MODULE

CROSS-REFERENCE TO PRIOR APPLICATIONS

This application is the U.S. National Phase application under 35 U.S.C. § 371 of International Application No. PCT/2019/058154, filed on Apr. 1, 2019, which claims the benefit of European Patent Application No. 18166000.2, filed on Apr. 6, 2020. These applications are hereby incorporated by reference herein.

FIELD OF THE INVENTION

The present invention relates to a lighting module comprising a housing and a woven fabric defining a light exit window across said housing, the housing comprising an acoustically absorbent panel opposing the woven fabric and a light engine arrangement on the acoustically absorbent panel arranged to generate a light output through the light exit window.

The present invention relates to a lighting kit comprising a plurality of such lighting modules.

The present invention further relates to a luminaire comprising at least one such lighting module.

BACKGROUND OF THE INVENTION

Advances in lighting technology such as the introduction of solid state lighting (SSL), e.g. as implemented by light emitting diode (LED)-based lighting modules, has transformed the lighting field. For example, lighting panels having very large surface areas, e.g. surface areas of several square meters ($m^2$), such as panels having a surface area in the range of 2-20 $m^2$ by way of non-limiting example, are now available that can transform the lighting experience in enclosed spaces such as large rooms, offices, halls and the like. Such panels, which may be composed of one or more lighting modules, in some application domains are provided as at least part of the ceiling of such enclosed spaces, where they provide substantially homogeneous lighting emanating from parts of the ceiling defined by such panels.

For example, U.S. Pat. No. 7,303,305 B2 discloses a ceiling tile system comprises modular acoustic light-emitting modules, which can be of a standard size to be fitted into a hung ceiling or other ceiling system in conjunction with similar acoustic light-emitting modules or conventional ceiling tiles. Each acoustic light-emitting module includes a backing panel, a cover, and a rigid spacing member extending between the backing panel and the cover, with solid state light-emitting elements such as light-emitting diodes (LEDs) arrayed within each module.

One particular challenge associated with such (large area) lighting modules is that in addition to their optical function, they also need to perform an acoustic dampening function in order to preserve the desired acoustics in the enclosed space in which they are fitted. Solutions exist in which such acoustic dampening is provided using glass fibre-based carrier plates that are held in place by a metal frame. This assembly forms the housing of the light engine(s), e.g. LEDs. Within such a housing, many light engines such as LEDs may be suspended such that the LEDs face the highly reflective acoustic panels, thereby indirectly illuminating the light exit window of the lighting module, which may be defined by an acoustically transparent member such as a woven or knitted fabric that allows the sound waves to travel through the light exit window such that they can be dampened by the glass fibre panels within the housing. Materials such as plastics and glass are unsuitable as the light exit window material of choice due to their high acoustic reflectivity. However, the optical reflectivity of typical glass fibre panels is limited to 80-85%, which is suboptimal in particular in large area applications. This may be improved using advanced coatings such as sol-gel coatings, but this often is cost-prohibitive.

Therefore, an alternative approach is to mount the light engines such that they directly illuminate the woven or knitted fabric in order to improve the optical efficiency of the lighting module. However, due to the open nature of such fabrics caused by the regular spacing of openings between the woven or knitted (strands of) fibres, this means that the light engines may become directly visible to a person looking directly at the lighting module under certain viewing angles. This is also undesirable, e.g. from an aesthetic perspective as well as to suppress glare.

The direct visibility of the light engines may be reduced by applying a coating to the fabric, but this significantly reduces the acoustic transparency of the fabric as the aforementioned inter-fibre holes become at least partially blocked by the coating. In addition, the optical efficiency of the lighting module is reduced due to additional light absorption by the coated fabric that results from reduced scattering by the fibre bundles as the effective diameter of a single fibre shifts towards that of at least part of the fibre bundle.

An alternative solution to the problem of direct visibility of the light engines under certain viewing angles is to apply a dual-layer knitted fabric in which a hexagonally knitted layer overlays a linearly knitted layer at the holes in the latter layer, thereby eliminating see-through. However, although the acoustic transparency is well-preserved by this solution, it has the drawback that it is associated with significant light losses. Moreover, it significantly increases the cost of such a lighting module, due to the fact that the dual-layer fabric itself is costly, and larger numbers of (under-driven) light engines and associated drivers are required to achieve a sufficient light output at an acceptable efficiency.

SUMMARY OF THE INVENTION

The present invention seeks to provide a lighting module in which at least some of the aforementioned drawbacks have been addressed.

The present invention further seeks to provide a lighting kit comprising a plurality of such lighting modules.

The present invention further seeks to provide a luminaire comprising at least one such lighting module.

According to an aspect, there is provided a lighting module comprising a housing and a woven fabric defining a light exit window across said housing, the housing comprising an acoustically absorbent panel opposing the woven fabric and a light engine arrangement in between the acoustically absorbent panel and the woven fabric, and arranged to emit light in a direction towards the woven fabric, the lighting module further comprising a felt-based volumetric diffuser in between the woven fabric and the light engine arrangement.

The present invention is based on the insight that a felt-based volumetric diffuser, e.g. a felt mat or the like, when positioned in between the light engine arrangement and the woven fabric acting as the light exit window of the lighting module, can achieve a more effective obscuring of the light engine arrangement independent of the viewing angle under which a person is directly looking at the lighting module, whilst not significantly deteriorating light output efficiency and acoustic absorbance of the lighting module.

Preferably, the felt-based volumetric diffuser has a constant optical density such that a constant optical performance over the full area of the light exit window of the lighting module is achieved. To this end, the felt may be composed of non-woven, (hollow) fibres, in which the fibres may be linearly aligned substantially parallel to the plane of the light exit window of the lighting module, such that light and sound waves can pass around the fibres without significantly affecting the light output efficiency and acoustic absorbance of the lighting module. However, any type of felt having a constant optical density, e.g. felts spun in a rotating manner, a felt having different individual layers of fibres stacked on top of each other in sinusoidal or slightly cross-stacked layering, and so on.

The felt may be composed of (hollow) fibres having a diameter in a range of 5-200 micrometers (sm). Preferably, the felt is composed of fibres having a diameter in a range of 5-100 micrometers. More preferably, the felt is composed of fibres having a diameter in a range of 5-50 micrometers. When the fibres have a diameter within this range, it has been found that non-uniformities in the light output of the lighting module due to lens effects of the fibres are effectively avoided or suppressed.

In a particularly advantageous embodiment, the woven fabric comprises openings having a minimum diameter, and said fibres have diameters that are smaller than said minimum diameter. This ensures that each opening in the woven fabric is aligned with a plurality of fibres in the felt, which obscures the light engine arrangement from direct view under certain viewing angles in a particularly effective manner. For example, each of said openings may have a diameter in a range of 20-500 micrometers in order to give the woven fabric the desired optical and acoustical transparency.

In at least some embodiments, the felt has a density in a range of 35-100 g/m$^3$. When the felt has a density in this range, it has been found that the light scattering characteristics of the felt are optimized, whilst the optical recycling losses are minimized. When the felt has a lower density, the openness of the felt will increase the visibility of the light engine arrangement under certain viewing angles, whereas if the felt has a higher density, the optical losses caused by the felt are significantly increased.

The felt may have a thickness in a range of 2-10 millimeters (mm). When the felt has a thickness in this range, it may be particularly easily handled and integrated into the lighting module.

The felt is composed may be composed of plastic, glass or quartz-based fibres, of which glass or quartz-based fibres are particularly preferred due to the optically transparent nature of such fibres, as well as to their fire-retardant nature. The felt may be composed of fibres that are bonded by an optically transmissive binder in order to give the felt particularly advantageous mechanical (handling) properties, such that for example when the felt is cut from a roll the material does not easily fall apart. Also, in a felt the orientation of the fibres is typically fixed, such that handling of the felt does not alter its optical density. For example, the felt may be composed of glass or quartz-based fibres having a diameter in a range of 5-50 μm that are impregnated with a polyvinyl alcohol (PVA) binder, although other examples of course are equally feasible.

The woven fabric is typically stretched over the housing in order to give the lighting module an aesthetically pleasing appearance. The felt used for the felt-based volumetric diffuser may be less stretchable, such that stretching of the felt may cause damage such as tearing to the felt, in particular when the felt is stretched separately from the woven fabric. Therefore, the felt-based volumetric diffuser may be attached to the woven fabric or may be integral to the woven fabric to reduce the risk of such damage as the felt is supported by the woven fabric.

In a particular embodiment, the lighting module further comprises a mesh attached to the woven fabric, said mesh retaining the felt-based volumetric diffuser against the woven fabric in order to attach the felt to the woven fabric. Alternatively, the felt may be integrated into the woven fabric during the knitting or weaving of the fabric.

In another embodiment, the felt-based volumetric diffuser is suspended in a frame mounted in between the woven fabric and the acoustically absorbent panel in order to support the felt-based volumetric diffuser. This has the advantage that the felt-based volumetric diffuser may be spatially separated from the woven fabric anywhere in between the woven fabric and the light engine arrangement. As the amount of this spatial separation impacts upon the optical performance of the lighting module, this optical performance therefore may be controlled by positioning of the frame carrying the felt-based volumetric diffuser at a particular distance from the woven fabric.

According to another aspect, there is provided lighting kit comprising a plurality of lighting modules according to any of the herein described embodiment, wherein the lighting modules are configured to be coupled to each other. In this manner, large area lighting panels may be constructed in a modular manner by combining a plurality of the lighting modules according to one or more embodiments of the present invention, thereby significantly reducing the manufacturing complexity of such large area lighting panels.

A lighting panel assembled in such a manner may comprise lighting modules each having a separate woven fabric over the housing of the lighting module. Alternatively, the lighting kit may comprise a woven fabric that is common to the plurality of lighting modules such that upon assembly of the lighting panel the woven fabric spans the plurality of lighting modules.

According to yet another aspect, there is provided a luminaire comprising at least one lighting module according to any of the herein described embodiments. Such a luminaire for example may form part of a surface cladding arrangement such as a suspended ceiling or the like.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
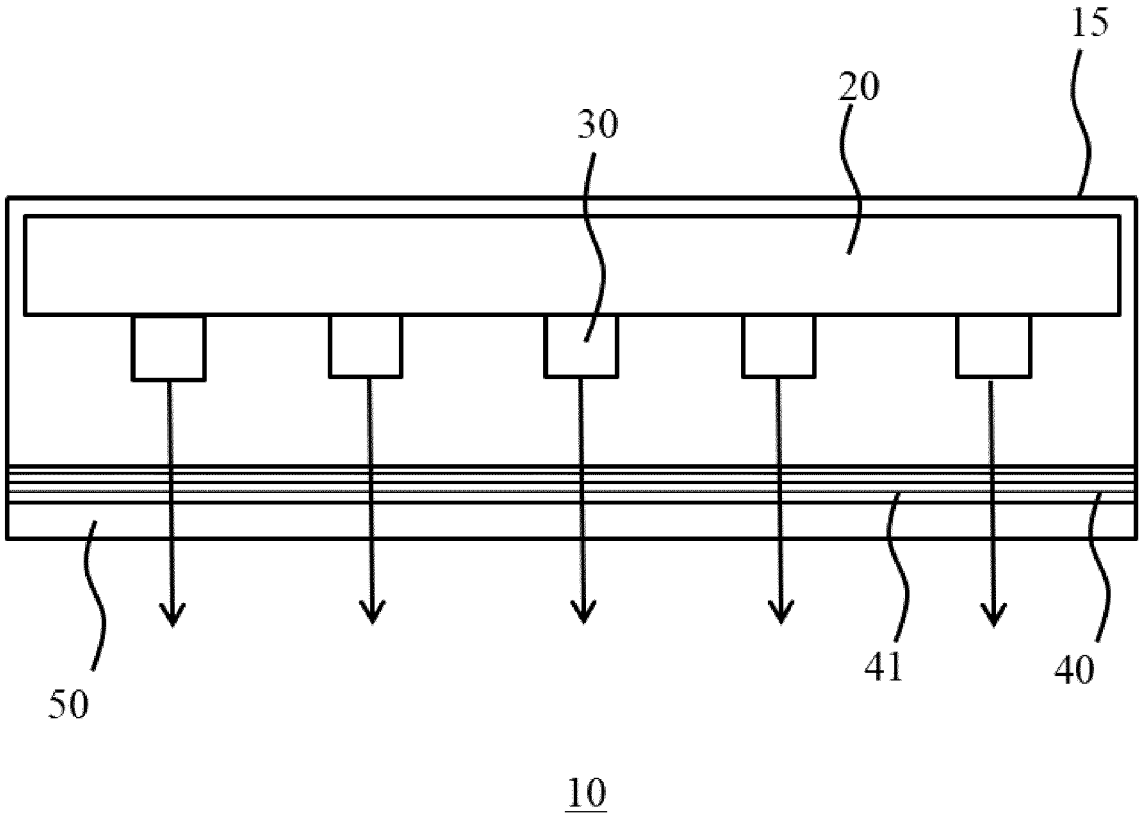
FIG. 1 schematically depicts a cross-sectional view of a lighting module according to an embodiment.

It should be understood that the Figures are merely schematic and are not drawn to scale. It should also be understood that the same reference numerals are used throughout the Figures to indicate the same or similar parts.

FIG. 1 schematically depicts a lighting module 10 according to an embodiment of the present invention. The lighting module 10 may take any suitable shape, such as of a light panel or the like that is to be mounted on a surface such as a ceiling or the like. The lighting module 10 comprises a housing 15 in which an acoustically absorbent material 20 is suspended. The housing 15 may take any suitable form, e.g. a box or frame or the like, and may be made of any suitable material, e.g. metal, plastic, wood and so on. The lighting module 10 may have a dedicated housing 15 or alternatively, a luminaire may be provided comprising a grid or array of lighting modules 10 that are suspended in a housing 15 common to these modules, e.g. a metal frame in which a plurality of recesses is present, with each recess housing one of the lighting modules 10.

The acoustically absorbent material 20 may be any suitable acoustically absorbent material that takes any suitable shape such as an acoustically absorbent mat or tile or the like. Suitable acoustically absorbent materials include fibrous materials that are commonly deployed in traditional acoustic tiles, such as glass wool, foam-based materials such as a melamine foam, polyurethane foam, and so on, as well as micro-perforated plates. Such micro-perforated plates may have a surface area of which about 0.2-0.5% is perforated with microscopic holes having a diameter in a range of 0.05-0.5 mm although other dimensions are of course equally feasible. Such micro-perforated plates may be folded in order to achieve the desired dimensions of the acoustically absorbent material 20 The acoustically absorbent material 20, e.g. the micro-perforated plate or any other acoustically absorbent material, may be filled with a substance that increases the acoustic absorbance of the acoustically absorbent material 20 to further improve the acoustic performance of the lighting module 10. The acoustically absorbent material 20 may be covered by a light-reflective coating (not shown), e.g. a white paint coating or a reflective foil, in order to minimize light losses of light generated by the one or more light engines 30 that is incident on the acoustically absorbent material 20. In an example embodiment, the acoustically absorbent material 20 such as a glass wool or the like is covered by a micro-perforated plate facing the light exit window of the lighting module 10, in which the micro-perforated plate not only acts as a further acoustically absorbent material but additionally acts as a light reflector to increase the optical efficiency of the lighting module 10. To this end, the micro-perforated plate may be coated with a reflective coating, e.g. a white paint or the like.

The light module 10 comprises a light engine arrangement comprising one or more light engines 30. Typically, the light engine arrangement comprises a plurality of light engines 30 that are distributed in a regular pattern such as a regular grid or array across the acoustically absorbent material 20. The one or more light engines 30 may be directly mounted on the acoustically absorbent material 20 or alternatively may be mounted on a separate carrier (not shown) that is positioned on or over the acoustically absorbent material 20. In the latter scenario, the carrier such as a PCB or the like is at least partially acoustically transparent, e.g. by having holes or the like therein, such that sound waves entering the lighting module 10 through its light exit window defined by the fabric or cloth 50 can reach the acoustically absorbent material 20. Such a carrier when present for example may be suspended in the housing 15 of the lighting module 10 and/or may be attached to the acoustically absorbent material 20.

The one or more light engines 30 of the light engine arrangement may take any suitable shape. In at least some embodiments, the one or more light engines 30 are LEDs such as COB LEDs. COB LEDs have a high luminous output which can assist in giving the lighting module 10 a bright appearance. In case of a plurality of light engines 30, the light engines 30 may be identical, e.g. white light LEDs, or may be different to each other, e.g. different coloured LEDs. The light engines 30 may be addressable as a single group, i.e. in unison, or may be individually addressable or may form part of an individually addressable group of light engines 30 in which case the light engine arrangement typically comprises a plurality of groups of light engines 30, e.g. groups of light engines 30 producing a different luminous output such as different coloured output. The one or more light engines 30 may be dimmable as will be readily understood by the skilled person. Alternatively, the luminous output intensity of the lighting module 10 may be controlled by switching on different numbers of light engines 30. In the latter scenario, the light engines 30 that are switched on in order to control the luminous output intensity of the lighting module 10 preferably are distributed across the lighting module 10 in order to preserve as much as a homogeneous illumination of the fabric or cloth 50 acting as the light exit window of the lighting module 10.

The fabric or cloth 50 acting as the light exit window of the lighting module 10 is spanned or tensioned across the housing 15 of the lighting module 10 such that the light emitted by the one or more light engines 30 of the light engine arrangement passes through the fabric or cloth 50 as indicated by the arrows in FIG. 1. The fabric or cloth 50 obscures the one or more light engines 30 from direct view. The fabric or cloth 50 typically is a woven fabric in which holes are present in between the intertwined fibres or threads of the fabric or cloth 50 which allow for sound waves to pass through the cloth or fabric 50 towards the acoustically absorbent material 20, where such sound waves may be absorbed, whilst at the same time allowing for light emitted by the one or more light engines 30 to pass through the fabric or cloth 50 in the opposite direction. In at least some embodiments, the one or more light engines 30 are arranged such that their light emitting surfaces are facing the fabric or cloth 50 such that the fabric or cloth 50 is directly illuminated by the one or more light engines 30, but it should be understood that other arrangements, e.g. side-lit and indirect lit arrangements, may also be contemplated.

The fabric or cloth 50 may be made of any suitable woven or knitted material that is both optically and acoustically transmissive, e.g. optically and acoustically transparent. Where the optical module 10 is to be used as a standalone luminaire, the fabric or cloth 50 typically spans a single lighting module 10. Alternatively, in embodiments in which the luminaire comprises a housing 15 that houses a plurality of lighting modules 10, the fabric or cloth 50 may span the housing 15 such that the fabric or cloth 50 is common to the plurality of lighting modules 10 mounted in such a housing. In yet another embodiment, such a luminaire may be formed by a plurality of lighting modules 10 each having their dedicated fabric or cloth 50 acting as a light exit window, in which case the respective lighting modules 10 may be assembled together to form the luminaire in any suitable manner, e.g. by suspension in a mounting frame or the like. The fabric or cloth 50 may be tensioned over the housing 15 in any suitable manner. As this is entirely routine to the skilled person, this will not be explained in further detail for the sake of brevity only.

In accordance with embodiments of the present invention, the lighting module 10 further comprises a felt-based volumetric diffuser 40, from here on simply referred to as felt 40. The felt 40 is positioned in between the fabric or cloth 50 and the light engine arrangement including the one or more light engines 30 such that the felt 40 is not directly visible external to the lighting module 10, but instead is hidden from direct view by the fabric or cloth 50. In FIG. 1, the felt 40 is integral to the fabric or cloth 50 such that the felt 40 is supported by the fabric or cloth 50. In this manner, when tensioning the felt 40 over the housing 15 of the lighting module 10, the risk of tearing the felt 40 during such tensioning is significantly reduced. The felt 40 may be integrated into the fabric or cloth 50 during weaving or knitting of the fabric or cloth 50 although as will be explained in more detail below, the felt 40 may be integrated in the lighting module 10 in between the fabric cloth 50 and the light engine arrangement including one or more light engines 30 in any suitable manner. Also, where the housing 15 houses a plurality of lighting modules 10, the felt 40 may be common to the plurality of lighting modules 10 as previously explained for the fabric or cloth 50.

In the context of the present invention, where reference is made to a felt 40, it should be understood that this term is intended to cover any pressed fibrous material such as a pressed fibrous mat or the like in which the fibres 41 are matted or otherwise bound together and preferably extend linearly substantially in parallel with the opposing major surfaces of the pressed fibrous material, i.e. the felt 40, such that light (and sound) can pass through the felt 40 through spacings in between the fibres 41, with light incident of the fibres 41 being scattered by the fibres 41, which gives the felt 40 its diffusive character. The fibres 41 typically are non-woven, (hollow) fibres in which a cross-sectional dimension perpendicular to the length of the fibre will be referred to as the diameter of the fibre. Where reference is made to such a diameter, it should be understood that this does not necessarily imply that the fibres 41 are (perfectly) tubular. Although the embodiments of the present invention are not limited to particular types of felt 40, it is noted that felts made from hollow plastic, glass or quartz fibres 41 are preferred due to the optical properties of such fibres 41. Due to the fire retardant (non-flammable) nature of glass and quartz fibres 41, such fibres 41 are particularly preferred in embodiments where the felt 40 is exposed to elevated temperatures. Due to the fact that such (hollow) linear fibres 41 can act as linear lenses, the diameter of such fibres 41 preferably does not exceed 200 μm in order to avoid lens effects such as interference effects such as striping when light passes through the felt 40. The fibres 41 in some embodiments of the present invention have a diameter in a range of 1-200 μm, preferably in a range of 5-100 μm and more preferably in a range of 5-50 μm. It has been found that the felt 40 retains excellent optical and acoustic transmissivity whilst avoiding lens effects when light passes through the fibres 41 in the felt 40. If the diameter of the fibres 41 is below 1 μm, the acoustic and optical transmissivity is adversely affected, whereas if the diameter of the fibres 41 is above 200 μm, lens effects may start to appear at the fabric or cloth 50. Of course, where such lens effects are considered desirable, e.g. for aesthetic reasons, the fibres 41 may have diameters exceeding 200 μm although this may compromise the ability of the felt to obscure the light engines within the lighting module 10 as explained. From the foregoing, it should furthermore be understood that the fibres 41 may be hollow or solid fibres, as the orientation of the fibres 41 does not require light and sound waves to pass through the fibres 41. It is furthermore reiterated that although linear fibre-felts have been described, any suitable type of fibre-based felt having a constant optical density may be used, such as for example felts that are spun using a rotating 'shower-head'-style depositing member onto a stationary or rotating support, although such felts may be more costly. Such a rotary fibre deposition technique for example is advantageous when using hot plastic fibres, as in such a case no adhesive or binder may be required to adhere (stick) the individual fibres together.

In some embodiments, the fibres in the felt 40 may be bound by an adhesive or a binder that has a good optical transparency to light in the visible part of the electromagnetic spectrum, e.g. an optical transparency of at least 80%, preferably of at least 90%. An example of such a binder is PVA although many other binders or adhesives will be immediately apparent to the skilled person. In the felts 40 to be used in the present invention, it is preferred that where such binders or adhesives are deployed, they are deployed in the form of micro-droplets in between individual fibres to ensure a thin application of such adhesives or binders. Alternatively, the fibres are impregnated with such adhesives or binders. As will be readily understood by the skilled person, the presence of such an adhesive or binder immobilizes the fibers 41 in the felt 40, thereby ensuring that the optical density of the felt 40 does not alter by reorganization of the fibres 41 when the felt 40 is being handled.

Felts 40 based on non-woven fibres are preferred as such felts have a well-defined uniform optical density across the surface of the felt, which is not the case when using materials based on woven fibres such as wool or the like, where the intertwined nature of such fibres causes local variations in the optical density of the material. In the embodiments of the present invention, the felt 40 may have a density in a range of 35-100 g/m2 to ensure optimal optical performance of the felt. When the density of the felt 40 is in this range, the spacing between the fibres 41 is sufficiently large to achieve a good optical transparency of the felt 40 whilst still obscuring the light engine(s) 30 from direct view under certain viewing angles as previously explained. The felt 40 may have a thickness in a range of 2-10 mm for the same reason, although other densities and thicknesses may be contemplated. Suitable felt materials are commercially available from for instance the Heraeus Group, Hanau, Germany and the Saint-Gobain Corporation of Paris, France.

Figure 2:
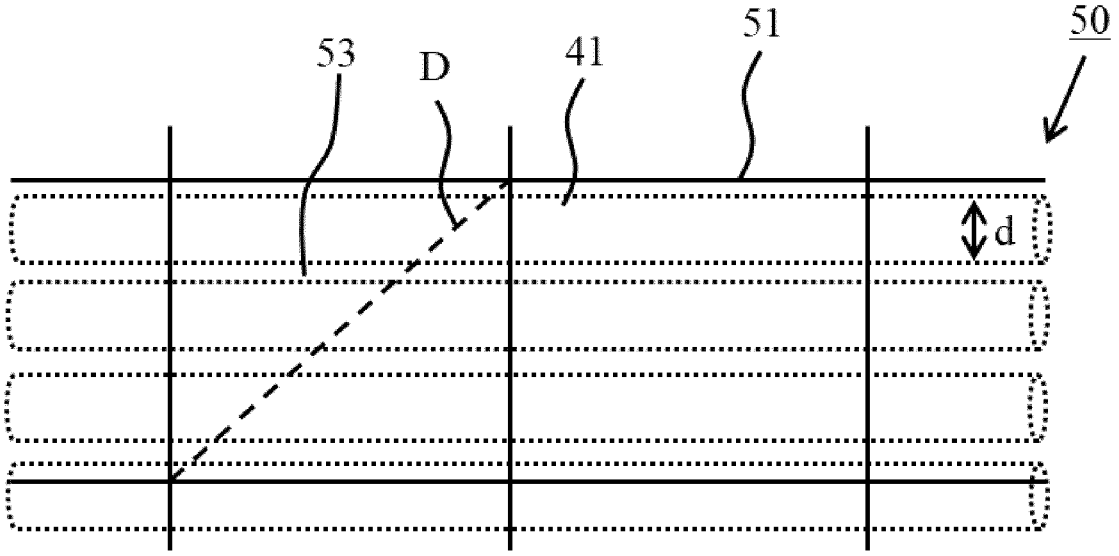
FIG. 2 schematically depicts an aspect of a lighting module according to an embodiment in more detail.

The felt 40 typically obscures the one or more light engines 30 from direct view through the fabric or cloth 50 under certain viewing angles due to the more closed nature of the felt 40 compared to the woven or knitted cloth or fabric 50. This is schematically depicted in FIG. 2, which depicts a particular embodiment of the present invention in which the fabric or cloth 50 has a woven or knitted structure in which holes 53 are present in between the lattice or weave of the fibres or threads 51 of the cloth or fabric 50. The holes 53 typically have a minimum cross-section or diameter D, which cross section or diameter D may be in the range of 20-500 μm. The fibres 41 of the felt 40 can be seen through the holes 53 in the fabric or cloth 50 in FIG. 2, where they are represented by dashed circles having a diameter d.

Preferably, the fibres 41 of the felt 40 are linear fibres having a diameter d chosen such that each hole 53 is covered by a plurality of the fibres 41 of the felt 40 when looking through the hole 53, which is typically achieved by choosing fibres 41 having a diameter d that is (substantially) smaller than the diameter D of the holes 53 in the fabric or cloth 50. As previously explained, the diameter d of the fibres 41 may be chosen in a range of 1-200 μm, preferably in a range of 5-100 μm and more preferably in a range of 5-50 μm. The diameter d in some embodiments is at most 0.2D to ensure that each hole 53 in the fabric or cloth 50 is covered by a plurality of the fibres 41 of the felt 40. In this manner, the one or more light engines 30 within the lighting module 10 are effectively obscured from direct view under a wide range of viewing angles.

Figure 3:
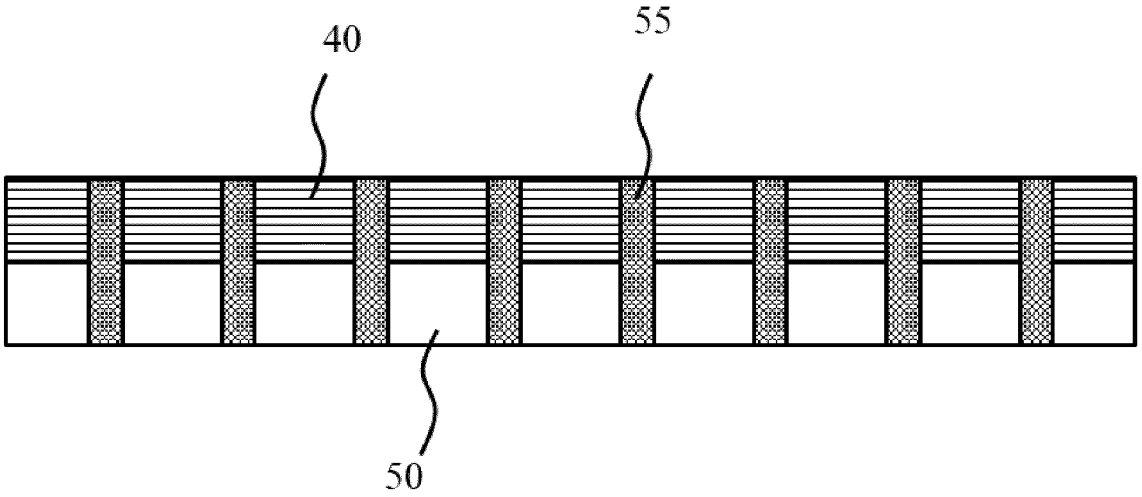
FIG. 3 schematically depicts a side-view of another aspect of a lighting module according to an embodiment in more detail.
Figure 4:
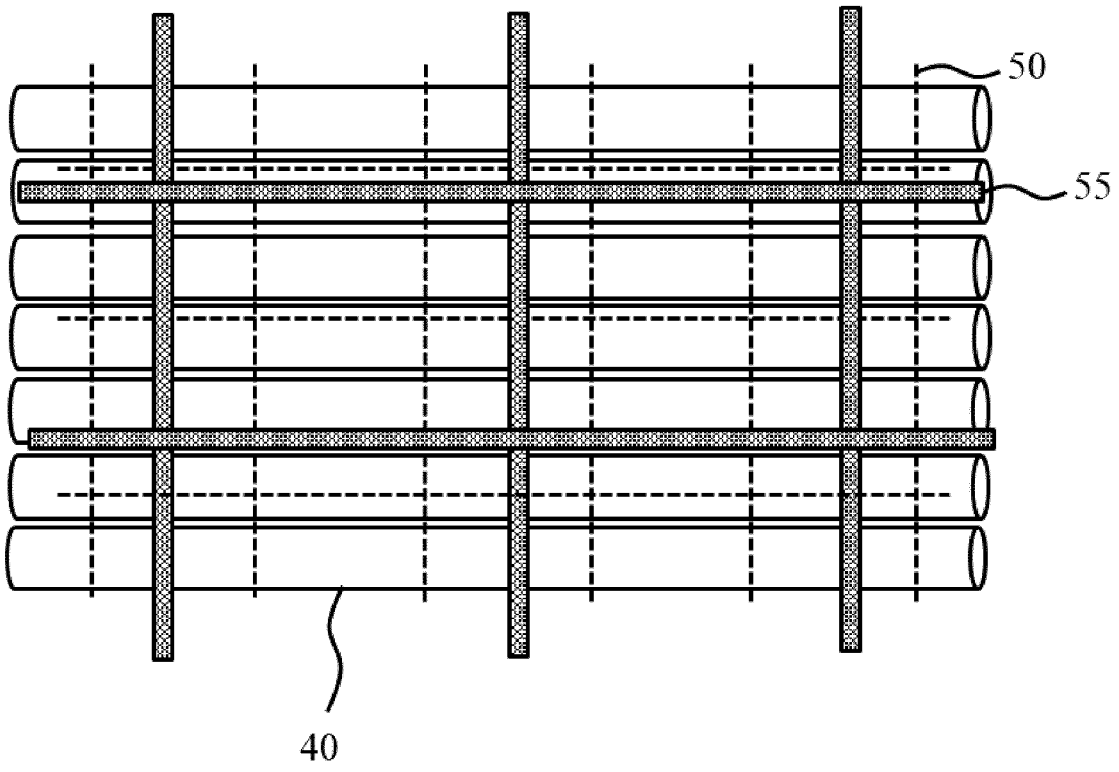
FIG. 4 schematically depicts a face on-view of another aspect of a lighting module according to an embodiment in more detail.

FIG. 3 schematically depicts a side-on view and FIG. 4 schematically depicts a bottom view of an alternative manner in which the felt 40 may be secured against the fabric or cover 50. In this embodiment, a fabric mesh 55 is stitched or otherwise attached to the fabric or cover 50, which fabric mesh 55 defines a pocket into which the felt 40 be inserted such that the fabric mesh 55 acts as a supporting member for the felt 40. Such a fabric mesh 55 may be a coarse mesh, e.g. having openings with a diameter of several mm or more, such that the fabric mesh 55 does not interfere with the optical and acoustic performance of the lighting module 10. Such a fabric mesh 55 may be made of any suitable material, such as glass, wool or acrylic fibres. Other suitable materials will be apparent to the skilled person.

Figure 5:
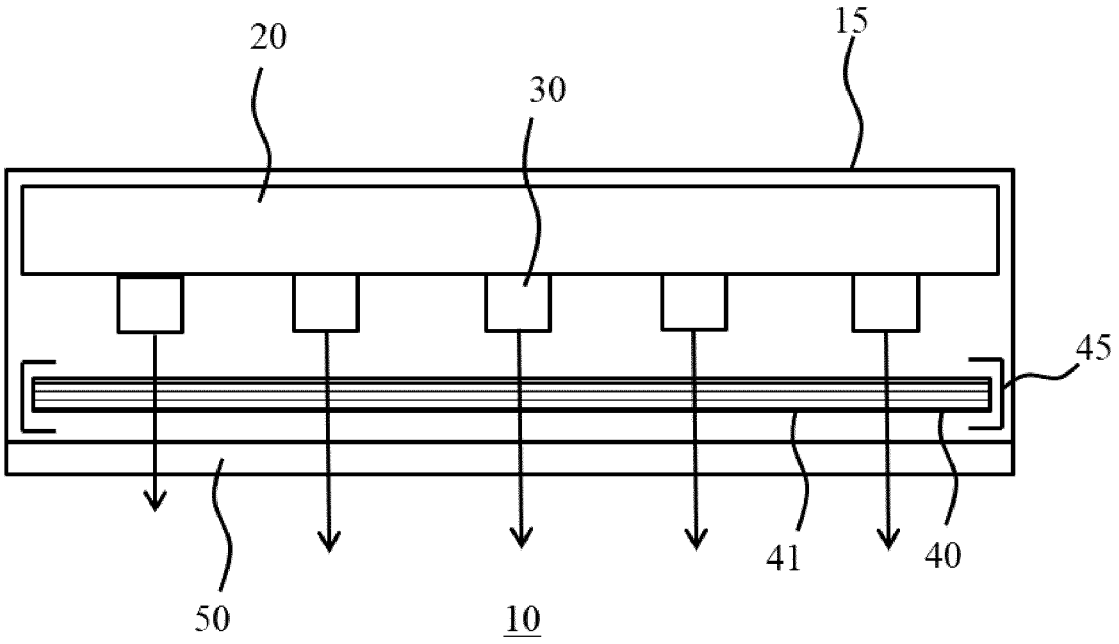
FIG. 5 schematically depicts a cross-sectional view of a lighting module according to another embodiment.
Figure 6:
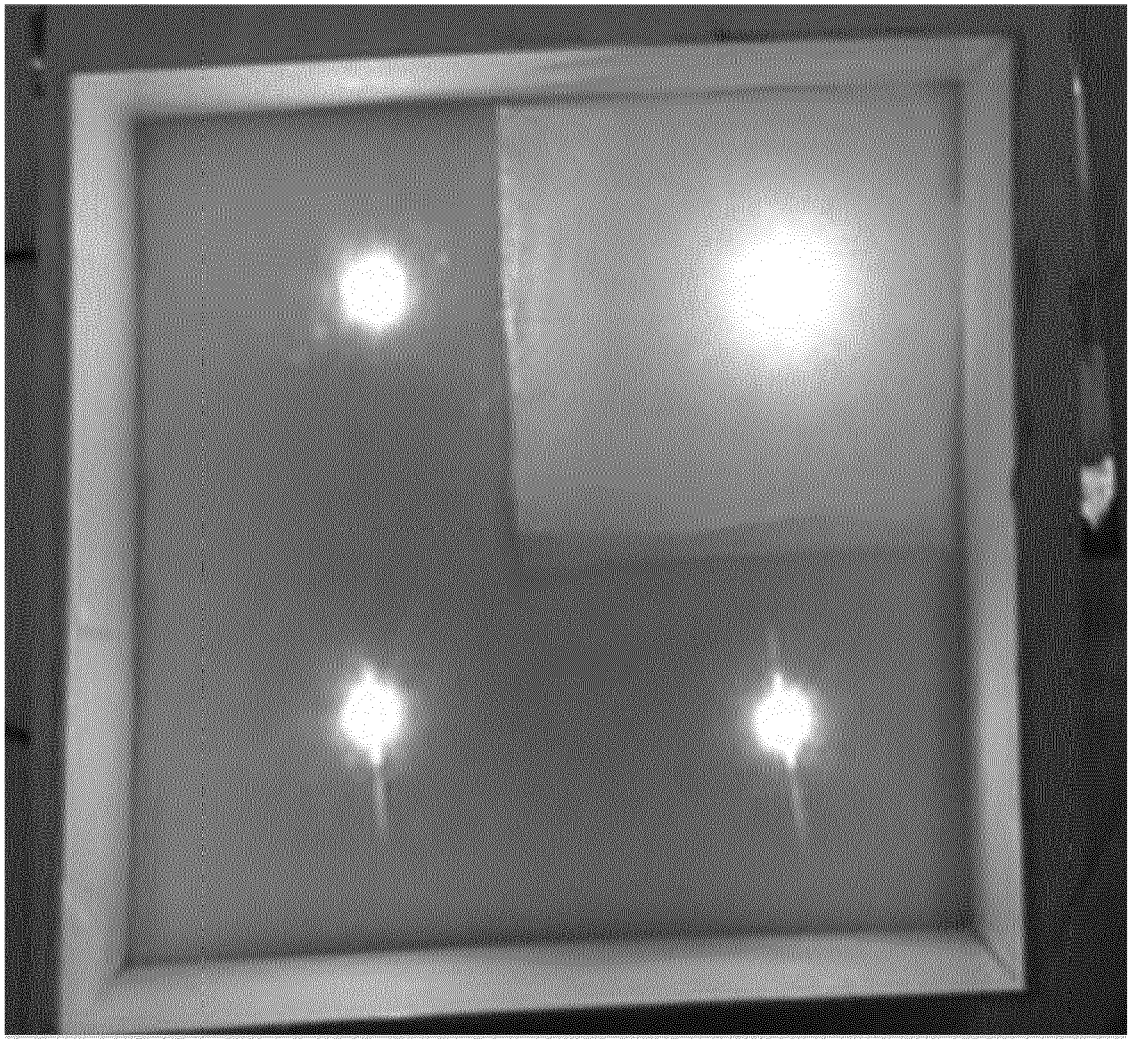
FIG. 6-8 depict photographic images of a luminaire according to different embodiments of the present invention.
Figure 7:
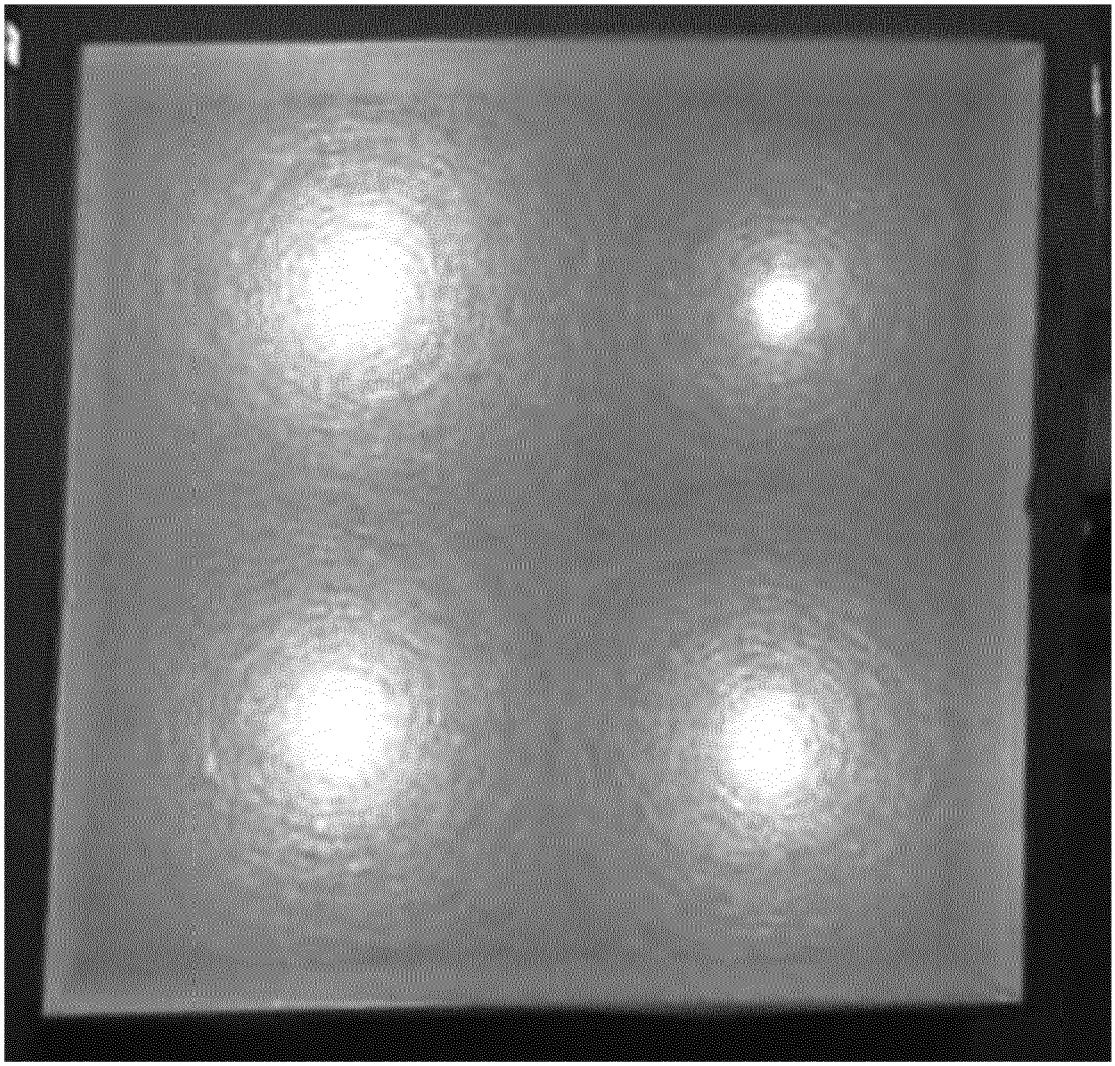
Figure 8:
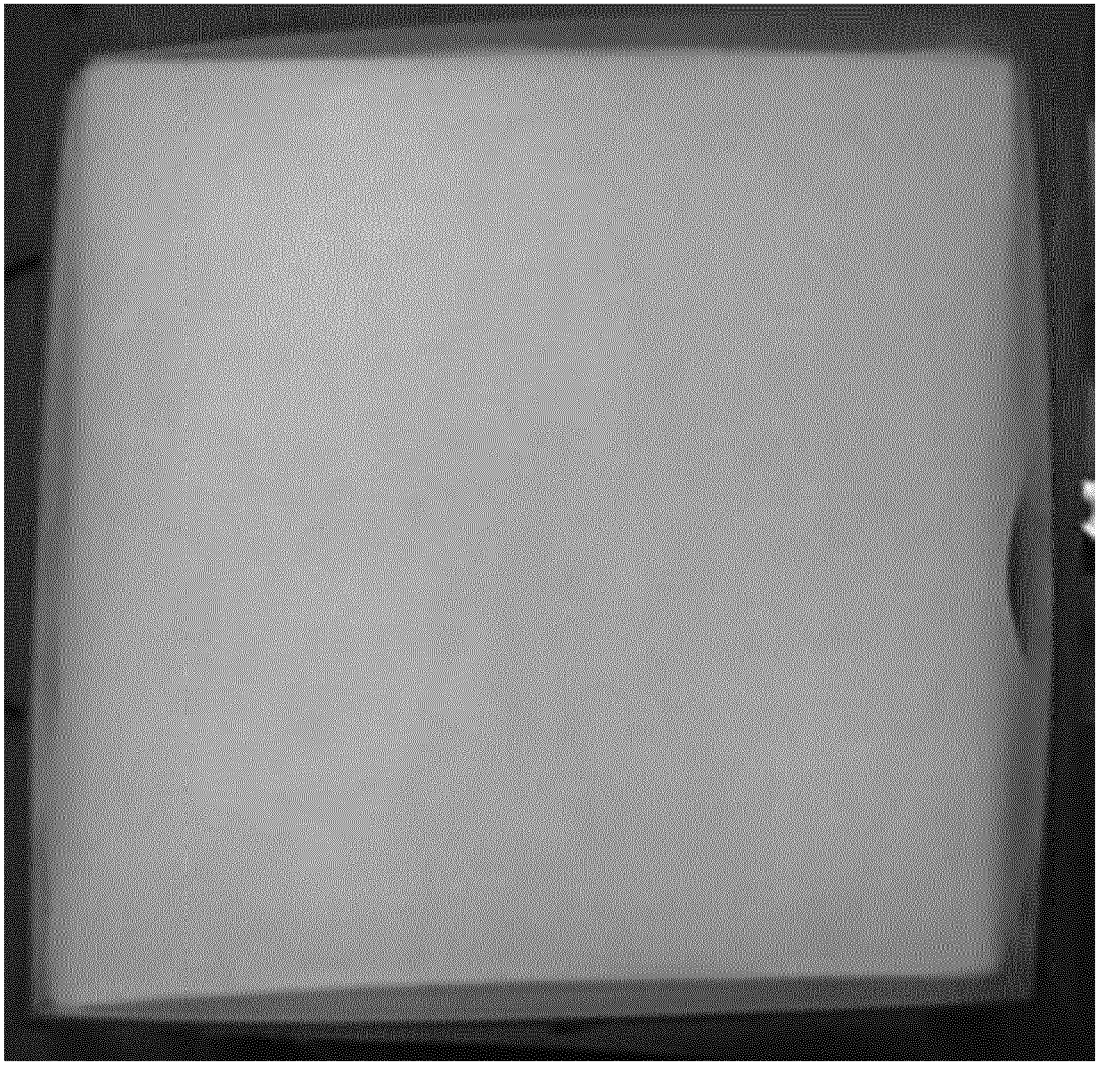

FIG. 5 shows yet another embodiment of the lighting module 10 in which the felt 40 is not secured against the fabric or cloth 50. Instead, the felt 40 is suspended in a supporting frame 45, e.g. a metal frame or the like in which the felt 40 is tensioned to reduce the risk of the felt 40 tearing when tensioning the felt 40 over the housing 15 of the lighting module 10 unsupported. This also provides the design of the lighting module 10 with an additional degree of design freedom as the supporting frame 45 may be mounted onto the housing 15 of the lighting module 10 at any distance from the fabric or cloth 50 in between the fabric or cloth 50 and the light engine arrangement. This for example may be used to tailor the appearance of the light module 10 when the one or more light engines 30 are switched on. This is shown in FIG. 6-8. In FIG. 6, the felt 40 is positioned directly over the light engines 30, whereas in FIG. 7 the felt 40 is positioned equidistantly between the light engines 30 and the fabric or cloth 50. In FIG. 8, the felt 40 is positioned directly against the fabric or cloth 50. It is noted that in FIG. 8, inhomogeneities in the luminous output of the lighting module 10 have been effectively suppressed, such that this spatial arrangement of the felt 40 and the fabric or cloth 50 is preferred where a homogenous luminous output is desirable for the lighting module 10.

Figure 9:
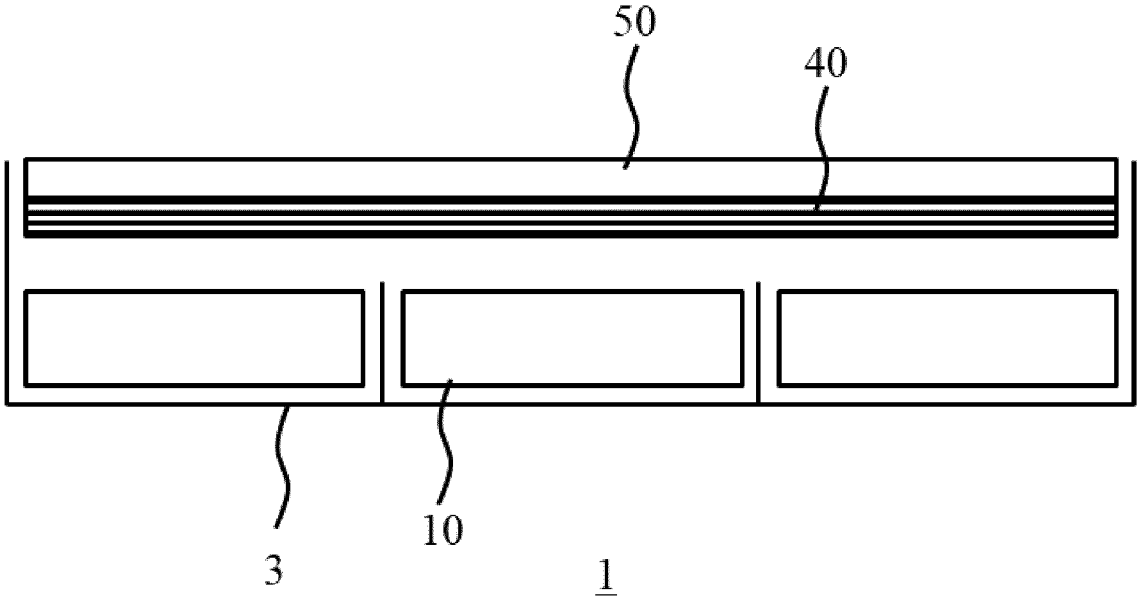
FIG. 9 schematically depicts schematically depicts a cross-sectional view of a luminaire according to an embodiment.

A plurality of lighting modules 10 according to embodiments of the present invention may be provided as a lighting kit, in which the lighting modules 10 are designed to be coupled to each other, either by fixings and/or by a common mounting frame as previously explained. In such a lighting kit, each lighting module 10 may have its own fabric or cloth 50 and felt-based volumetric diffuser 40 or alternatively the lighting kit comprises a single fabric or cloth 50 and felt-based volumetric diffuser 40 to be deployed across all the lighting modules 10 thereof. Such a lighting kit may be used to form a luminaire 1, an example embodiment of which is schematically depicted in FIG. 9, in which multiple lighting modules 10 are combined in a common housing 3, e.g. a mounting frame or the like, to form the luminaire 1. In FIG. 9, the fabric or cloth 50 and the felt-based volumetric diffuser 40 are common to (i.e. shared by) the lighting modules 10 by way of non-limiting example as it will be understood from the foregoing that each lighting module 10 in such a luminaire may comprise its own fabric or cloth 50 and felt-based volumetric diffuser 40. Moreover, it is noted for the avoidance of doubt that the luminaire 1 may be formed by a single lighting module 10 in an alternative embodiment.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting module comprising a housing and a woven fabric defining a light exit window across said housing, the housing comprising an acoustically absorbent panel opposing the woven fabric and a light engine arrangement in between the acoustically absorbent panel and the woven fabric, and arranged to emit light in a direction towards the woven fabric, the lighting module further comprising a felt-based volumetric diffuser in between the woven fabric and the light engine arrangement, wherein the woven fabric comprises openings with a diameter in a range of 20-500 micrometers, wherein the felt-based volumetric diffuser is composed of non-woven fibres having a diameter in a range of 5-200 micrometers, and wherein the fibres have diameters that are smaller than a minimum diameter of the openings.

2. The lighting module of claim 1, wherein the felt-based volumetric diffuser has a constant optical density.

3. The lighting module of claim 1, wherein the felt-based volumetric diffuser has a thickness in a range of 2-10 mm.

4. The lighting module of claim 1, wherein the felt-based volumetric diffuser is composed of plastic, glass or quartz-based fibres.

5. The lighting module of claim 1, wherein the felt-based volumetric diffuser is composed of fibres that are bonded by an optically transmissive binder.

6. The lighting module of claim 1, wherein the felt-based volumetric diffuser is attached to the woven fabric or is integral to the woven fabric.

7. The lighting module of claim 6, further comprising a mesh attached to the woven fabric, said mesh retaining the felt-based volumetric diffuser against the woven fabric.

8. The lighting module of claim 1, wherein the felt-based volumetric diffuser is suspended in a frame mounted in between the woven fabric and the acoustically absorbent panel.

9. A lighting kit comprising a plurality of lighting modules of claim 1, wherein the lighting modules are configured to be coupled to each other.

10. A luminaire comprising at least one lighting module of claim 1.

* * * * *